US005239792A

United States Patent [19]

Avni

[11] Patent Number: 5,239,792

[45] Date of Patent: Aug. 31, 1993

[54] EAVESDROPPING-PROOF ROOM AND SOUND DAMPENING DEVICES THEREFOR

[75] Inventor: Shlomo Avni, Givataim, Israel

[73] Assignee: Teletron Limited, Petah Tikva, Israel

[21] Appl. No.: 635,920

[22] Filed: Dec. 28, 1990

[30] Foreign Application Priority Data

Jan. 9, 1990 [IL] Israel ..... 93010
Jan. 9, 1990 [IL] Israel ..... 93011

[51] Int. Cl.[5] ..... E04B 1/99; E06B 5/10

[52] U.S. Cl. ..... 52/79.1; 52/171; 52/282.4

[58] Field of Search ..... 52/2.18, 171, 200, 80, 52/81, 144, 145, 282, 788-790, 280, 281, 282, 79.1; 181/154, 206, 287, 295

[56] References Cited

U.S. PATENT DOCUMENTS

| | | | |
|---|---|---|---|
| 2,917,793 | 12/1959 | Owen | 52/282 |
| 3,229,429 | 1/1966 | Conrad . | |
| 3,664,069 | 5/1972 | Ikai et al. | 52/2.18 |
| 3,740,903 | 6/1973 | Ahern | 52/81 |
| 3,827,531 | 8/1974 | Hansen . | |
| 3,985,957 | 10/1976 | Torn | 181/154 |
| 4,035,539 | 7/1977 | Luboshez | 52/790 |
| 4,347,381 | 11/1982 | Wilson | 52/80 |
| 4,352,039 | 9/1982 | Hagood et al. . | |
| 4,443,987 | 4/1984 | Erb | 52/789 |
| 4,613,530 | 9/1986 | Hood et al. | 52/171 |
| 4,761,921 | 8/1988 | Nelson | 52/33 |
| 4,829,729 | 5/1989 | Derner et al. | 52/171 |
| 4,860,511 | 8/1989 | Weisner et al. | 52/200 |
| 4,914,877 | 4/1990 | Bennett | 52/177 |
| 4,966,801 | 10/1990 | Becker et al. | 428/113 |
| 4,979,345 | 12/1990 | Celsi . | |

FOREIGN PATENT DOCUMENTS

| | | |
|---|---|---|
| 3417971 | 11/1985 | Fed. Rep. of Germany . |
| 2254758 | 9/1974 | France . |
| 2432581 | 7/1978 | France . |
| 2516120 | 11/1981 | France . |
| WO81/01026 | 4/1981 | PCT Int'l Appl. . |
| 357147 | 6/1930 | United Kingdom . |

OTHER PUBLICATIONS

European Search Report dated Apr. 21, 1992 (translated).

*Primary Examiner*—James L. Ridgill, Jr.
*Attorney, Agent, or Firm*—Merchant, Gould, Smith, Edell, Welter & Schmidt

[57] ABSTRACT

An eavesdropping-proof room comprises boundary components that are substantially transparent, at least from one surface thereof, whereby any device implanted therein is immediately visible. Sound dampening devices for aerating closed rooms are also provided, which comprise, optionally in combination with a fan or other device for withdrawing or introducing air, a casing, a number of partitions dividing said casing into various compartments and a number of channels connecting said compartments in such a way as to determine a zigzag path of the air flowing through the device and the withdrawal of a fraction of the air from each compartment, which results in a dampening of sounds carried by such air.

11 Claims, 10 Drawing Sheets

EAVESDROPPING-PROOF ROOM AND SOUND DAMPENING DEVICES THEREFOR

The present invention relates to means for preventing eavesdropping on conversations. More particularly, the invention relates to an eavesdropping-proof construction which will be termed hereinafter "eavesdropping-proof room". Furthermore the invention relates to devices for aerating closed rooms, while dampening the sounds that may issue from the room through the aerating openings and substantially preventing the issuance of any identifiable sounds therefrom.

The need for means for carrying out conferences in environments which are free from the so-called bugs, viz., devices or systems used to monitor or record a target area audio, is growing in later years because of the sophisticated technological methods and devices which have been developed, and which are easily obtainable on the free market, which methods can be employed, e.g. for industrial espionage [James A. Ross, Modern Technical Surveillance Countermeasures, Carnahan Conference on Security Technology, Atlanta, Ga. Jul. 15-17, 1987]. Many efforts have been devoted to countermeasure modern monitoring, especially by electronic means wired onto telephone or data lines, such as computer lines, as detailed in the abovenoted reference. All such countermeasures are designed to neutralize bugs already installed or which it is presumed that have been applied for eavesdropping purposes. However, little attention has been paid to means of preventing the installation of bugs and other methods of eavesdropping on voice conferences, which do not involve searching for bugs and taps.

It is an object of the present invention to provide means to ensure that a conversation is carried out in a bugs-free environment.

Such means, according to the invention, essentially comprise a construction which is substantially eavesdropping-proof, as will appear hereinafter. Therefore, it is another object of the invention to provide such a substantially eavesdropping-proof room construction.

The eavesdropping-proof room according to the invention comprises boundary components that are substantially transparent, at least from one surface thereof, whereby any device that might be implanted therein for transmitting or registering conversations that take place within the room or for eavesdropping on them in any way, will be immediately visible and easily removed. Said boundary components normally comprise walls, roof, floor and door.

According to a preferred embodiment of the invention, surfaces, preferably the outer surfaces, of said boundary components, or such of them as would permit seeing what occurs within the eavesdropping-proof room, are rendered opaque or, better still, specular.

According to another preferred aspect of the invention, the boundary components of the eavesdropping-proof room, or part of them, comprise at least two separate layers, made of sheets, plates or boards, which define cavities therebetween, to provide better acoustic insulation.

According to a further preferred aspect of the invention, the room is made up of standardized components, which afford a modular construction.

According to a further aspect, the boundary components are connected to one another by rigid angle members, connected thereto e.g., by means of bolts.

According to a further aspect, at least part of the boundary components consist of two layers, spaced from one another by means of distancer elements.

According to a further aspect, the boundary components or part thereof are made of modular sheets or plates, interconnected by joint elements overlapping the abutments of adjacent sheets or plates and connected thereto.

According to a further preferred aspect of the invention, means are provided for aerating the inside of the room and, preferably, such means are constructed in a sound-dampening configuration, to minimize the issue of sounds from inside the room.

According to a preferred embodiment of the invention, the means for preventing eavesdropping according to said invention comprise, in combination with an eavesdropping-proof room, means for generating noise around the room or in the cavities that exist in the boundary elements thereof.

According to a preferred embodiment of the invention, the noise generated is white noise, and white noise generators may be positioned in any appropriate position in any appropriate number, e.g., in the space surrounding the eavesdropping-proof room.

The room according to the invention can be made of a variety of materials. In order to permit the preferred constructions to be carried into practice, the materials should be transparent even when some outer surfaces of the constructed room may be rendered opaque or specular. Certain transparent construction materials such as glass, however, are not convenient because of their weight or because of their fragility or other reasons, but they may of course be used to construct a room according to the invention or parts thereof if their drawbacks are accepted. Other materials that are satisfactory from the viewpoint of transparency and weight and shock resistance are generally not acceptable because they are excessively inflammable and should not be used, except in relatively minor quantities. For this reason, a combination of different materials may be resorted to. Thus, if one material is relatively flexible or at least insufficiently rigid, it may be employed in combination with stiffening elements of another rigid material, which will not be used alone because of one or more of the aforementioned drawbacks. One material which is satisfactory from all viewpoints, but is difficult to be used alone because of its relative flexibility, is polycarbonate. A material which may be used to stiffen polycarbonate elements, although it should not be used alone because of its relative inflammability, is Perspex. Perspex can also be used as the sole or major component of the building material, provided that suitably flame-retarded material is employed, since Perspex alone is a relatively flammable material.

As has been said, another object of the invention is to provide an eavesdropping-free room which is of a modular construction, and can therefore be built in various sizes starting from a limited number of basic elements.

All boundary elements of the eavesdropping-proof room of the invention must be sufficiently transparent, to render any microphones or bugs of any kind implanted therein immediately visible, at least to persons from within the room. However, according to a preferred embodiment of the invention, the walls of the room, particularly the outer walls, and all other boundary elements from which one could see from the outside into the room viz., in some cases the roof or even the floor, are treated in order to render them specular and thus to provide a mirror-like effect which will make it impossible or at least very difficult to see the inside of the room from the outside. Thus, people in conference within the room can speak freely without the danger of their words being picked up by lip-reading, and can freely exhibit documents, since these cannot be photographed or seen from the outside.

It is a further purpose of this invention to provide a device which will permit aerating a closed room while minimizing the possibility of eavesdropping on conversations that take place in the room or discovering their content through the sounds which are carried by the air drawn or escaping from the room.

It is another purpose of the invention to provide such a device which may be constructed entirely or essentially of transparent material, to prevent the installation, in the device itself, of bugs and other methods of eavesdropping on voice conferences, by making any such bugs or the like immediately visible.

It is another purpose of the invention to provide such a device which will permit immediate identification of such bugs or the like and yet will not permit spying from the outside on what takes place in the room in order to acquire information on conferences taking place therein, by lipreading or by scanning or photographing of documents or other items that may be exhibited during the conference.

It is still another purpose of the invention to provide an aerating device which permits to introduce fresh air into a closed room, while minimizing the introduction of noise from the outside.

The aerating device according to the invention comprises, optionally in combination with a fan or other device for withdrawing or introducing air, a casing, a number of partitions dividing said casing into various compartments and a number of channels connecting said compartments in such a way as to determine a zigzag path of the air flowing through the device and the withdrawal of a fraction of the air from each compartment, which results in a dampening of sounds carried by such air.

In a preferred embodiment of the invention, the channels connecting the compartments of the device have a cross-section that is considerably smaller than the cross-section of the compartments, whereby to cause the air to expand when issuing from a channel into a compartment, whereby to enhance the dampening effect.

In another preferred embodiment of the device, the casing, the partitions and the channels thereof are constructed of transparent material.

According to another preferred embodiment of the device, the casing, partitions and channels of the device are constructed of transparent materials but at least one surface thereof is rendered non-transparent, preferably on one side only, by applying to it an opaque or reflecting coating, in order to render it impossible to see from the outside what occurs within the room to which the device is applied.

Fans or other devices for drawing or introducing air may be included in the device according to the invention, various ways. It is possible, for instance, to apply to the room one device provided with a suction fan and to allow air to enter into the room through an opening to which a device according to the invention is applied, without including in this latter an impelling fan. Alternately, such a fan may be employed. It is also possible to employ a device according to the invention provided with a fan for introducing air into the room, and to allow air to exit therefrom through a device according to the invention which is not provided with a fan. One may also employ an impelling fan for introducing air into the device without providing a device according to the invention at said inlet, relying on the fact that at an opening at which air is forced into the room and does not exit therefrom, no sounds may escape. These and other combinations as well, as well as the use of any desired number of devices according to the invention, may be carried into practice by skilled persons depending on the specific conference room to which the invention is applied.

All of the aforesaid and other objects, characteristics and advantages of the invention will be better understood from the following illustrative and non-limitative description of a preferred embodiment of the invention, with reference to the appended drawings wherein.

Figure 1:
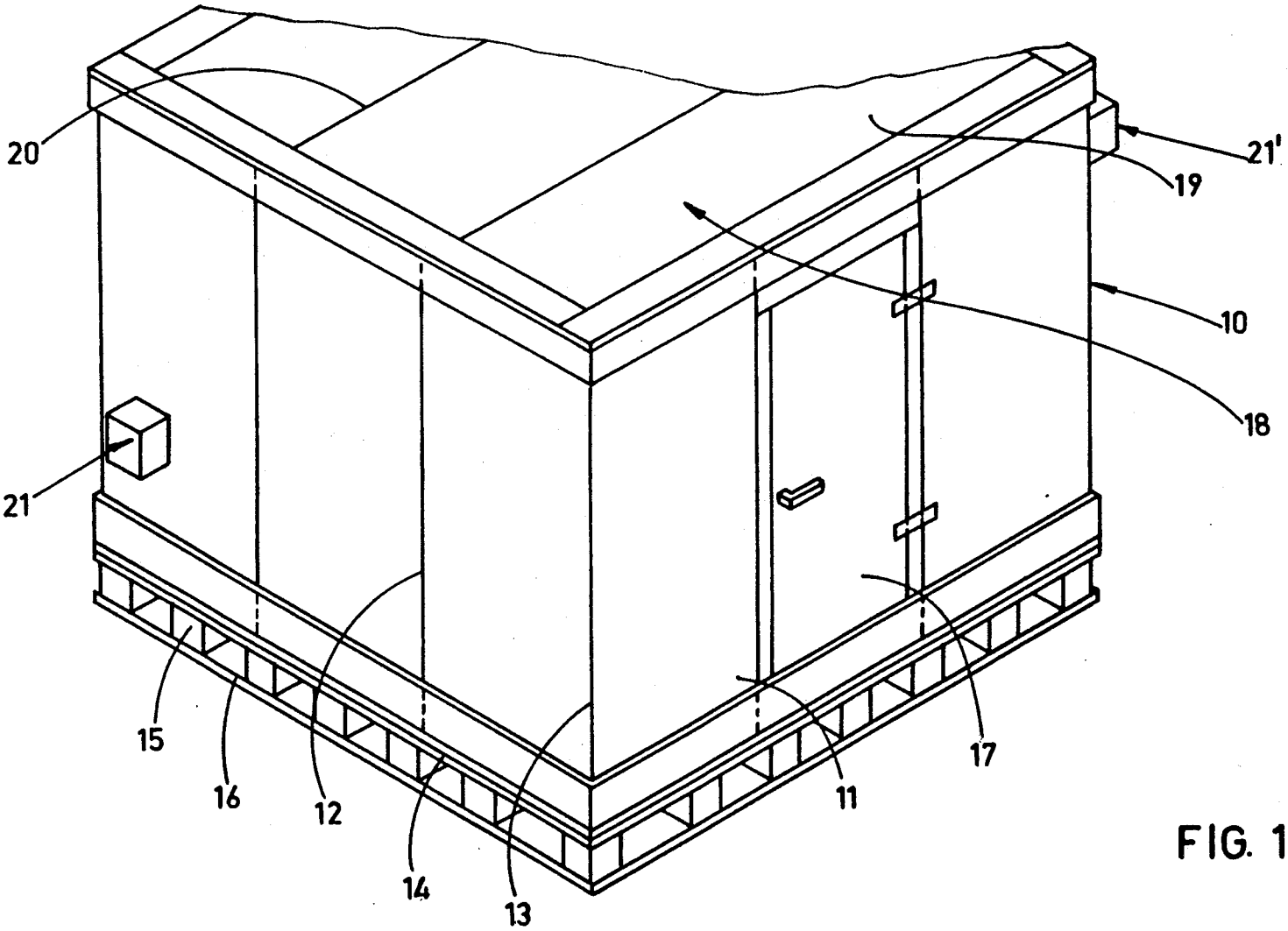
FIG. 1 is a perspective view of an eavesdropping-proof room according to an embodiment of the invention.

With reference now to FIG. 1, an eavesdropping-proof room 10 according to one embodiment of the invention is schematically shown in perspective view. Room 10 consists of a plurality of wall elements 11 juxtaposed at 12 and at 13 and connected to one another in ways that will be described hereinafter. Wall elements 11 rest on a floor 14 and are connected thereto in a manner to be described. Floor 14 in turn is raised from the ground and rests on supports 15, resting in turn on a supporting surface 16 which may be the ground but will usually be the floor of the building in which the eavesdropping-proof room is housed. Numeral 17 designates an entrance door, numeral 18 designates the roof, which is also of modular construction and comprises roof elements 19 connected at seams 20 as will be described hereinafter. Any desired number of aerating devices may be provided and two of them are schematically indicated in FIG. 1 at 21, designating the inlet of air, and at 21', designating the air outlet.

Normally, a plurality of air inlet devices, such as device 21, will be provided, and a corresponding number of outlet devices will also be present, to permit the circulation of air through the room. The number and air flow rate of the aerating devices will of course be dictated by the standards which are issued from time to time by the competent authorities, and the skilled engineer will be able to provide adequate ventilation conditions.

According to a preferred embodiment of the invention, the inlet of air is effected at a lower position along the walls of the room, and the outlet at a higher position, as schematically indicated in FIG. 1. Likewise, in a preferred embodiment of the invention, still as shown in FIG. 1, the outlet and inlet of air are positioned on opposing walls. These, however, are only preferred modes of operation, and very different inlet/outlet arrangements can of course be devised by the skilled engineer.

Figure 2:
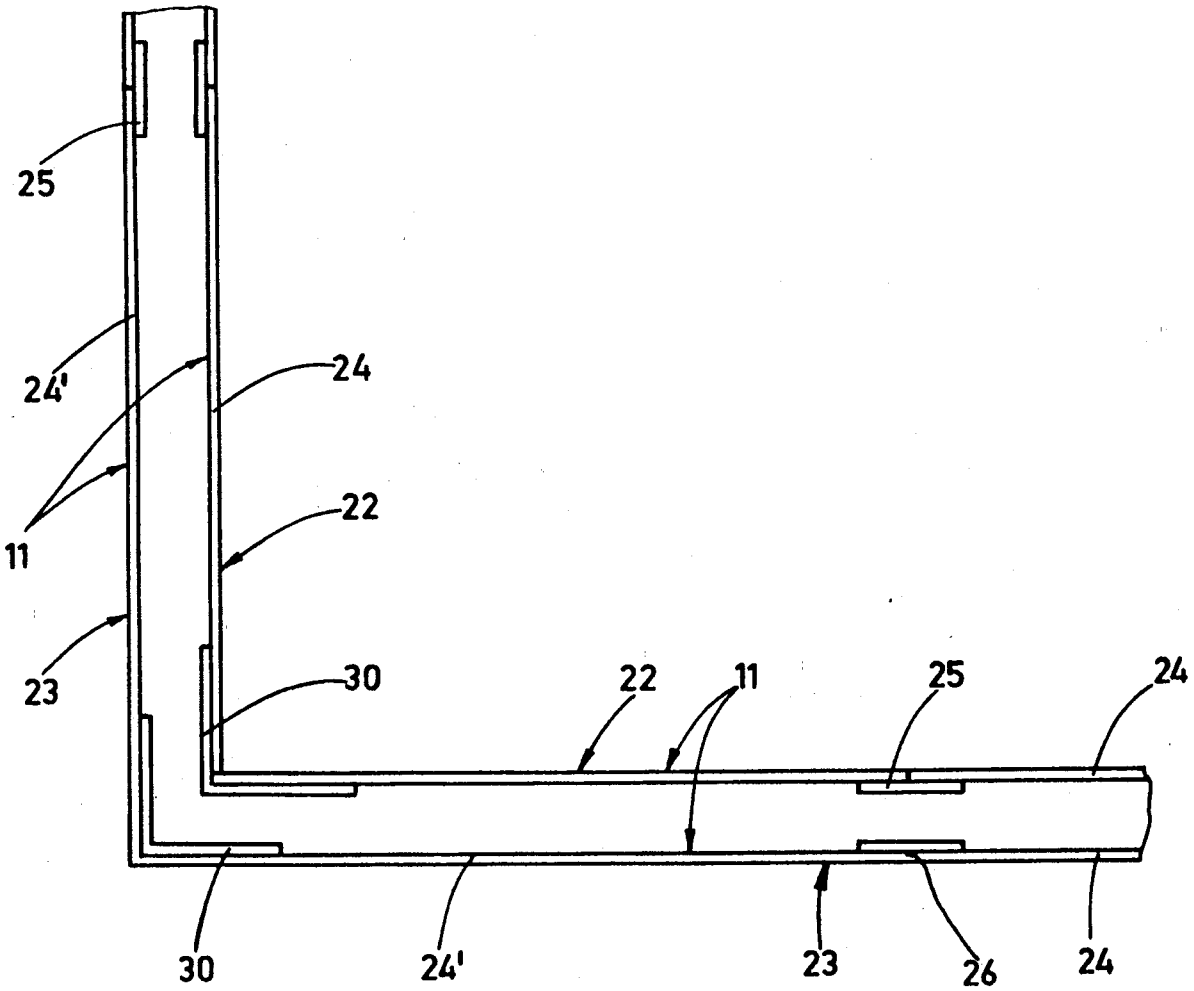
FIG. 2 is a schematic horizontal cross-section showing two walls of the room of FIG. 1 adjacent an angle thereof.

FIG. 2 schematically illustrates in horizontal cross-section the construction of the walls. Wall elements 11 comprise each two layers, preferably made, in this embodiment, of Perspex. Alternatively, they can be made of polycarbonate plates or sheets, which are relatively flexible and are connected and rigidified by stiffening strips 25 and by angle strips 30, which are preferably made of Perspex. Numeral 22 designates the inner layer and numeral 23 the outer layer, both made of plates 24, which, in order to provide a modular construction, are preferably all of the same length. The plates 24' which form the angle of the outer wall 23 are conveniently longer. Numeral 26 indicates the abutting edges of plates 24, 24'.

Figure 3:
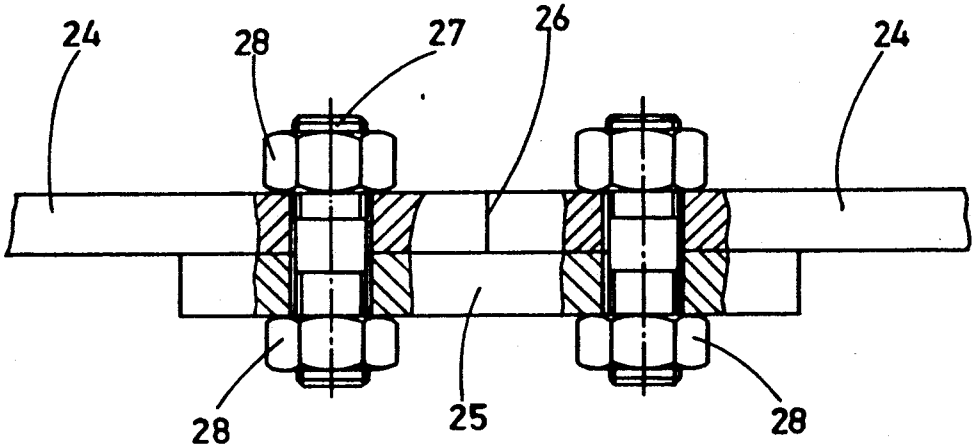
FIG. 3 is a detail of FIG. 2 at an enlarged scale.

As shown in FIG. 3, said plates are connected to stiffening strips 25 by means of bolts 27, made of any suitable plastic material, said bolts being provided each with nuts 28. It should be understood that, wherever there is not sufficient room in order to hold the nut 28 during assembly operations, the threading can be provided in the plate itself, e.g., plate 25, and the nut 28 can be integral with bolt 27 or dispensed with. As will be noted, the stiffening elements and bolts have been omitted in the schematic drawing of FIG. 1. At the angles, plates 24' of two different walls forming the angle are connected with the help of angle elements 30, in a manner that will be described hereinafter with reference to FIG. 4. It is seen that the walls are of modular construction and can be made of any desired length that is a multiple of the horizontal width of the plate elements 24, taking into account the presence of longer plate elements 24' adjacent at the angles of the outer walls 23.

Figure 4:
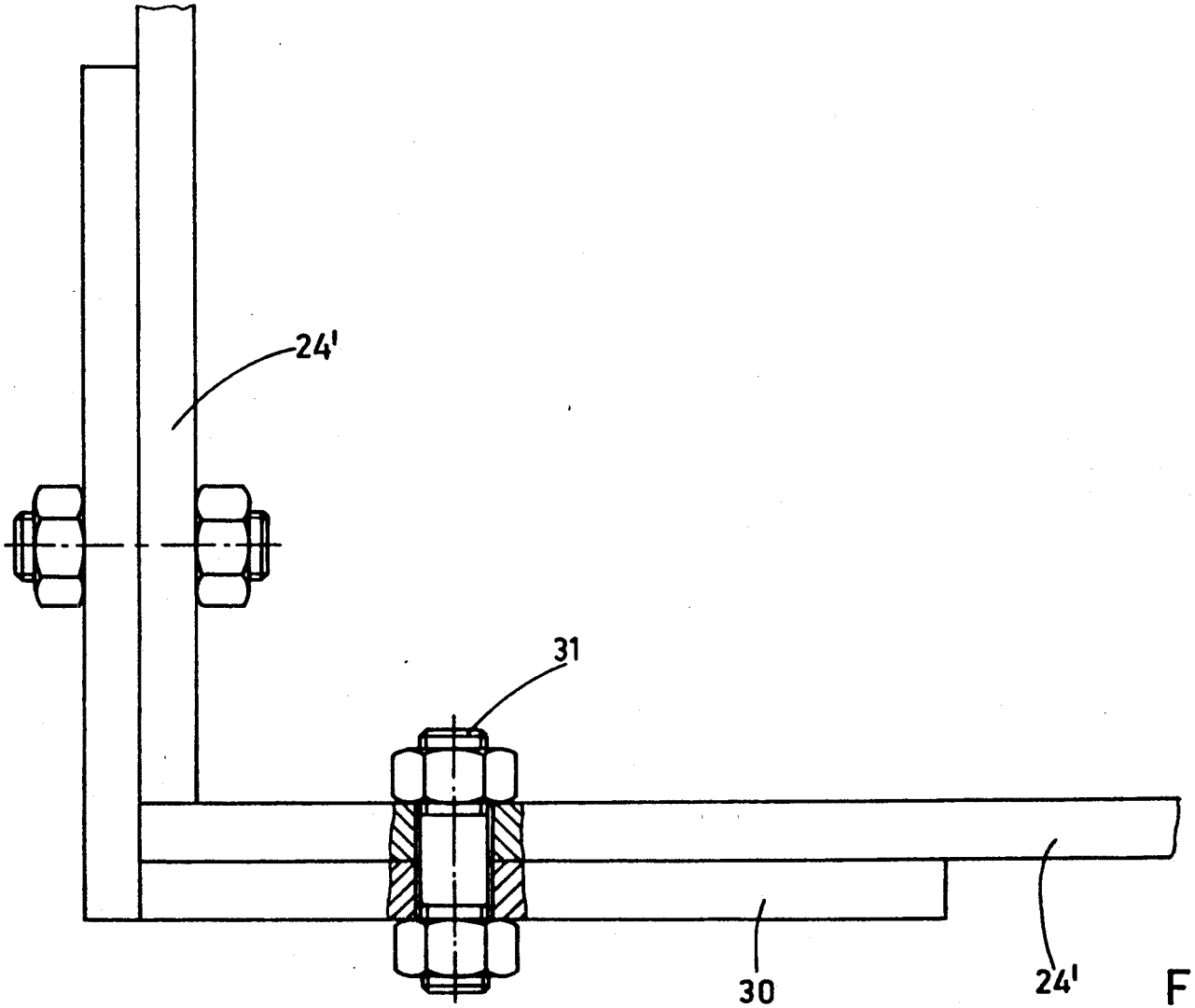
FIG. 4 is another detail thereof at an enlarged scale.

FIG. 4 schematically indicates the connection of two wall plates at the angles. FIG. 4 may be taken to illustrate the connection of either the inner or the outer layers 22–23, said connections being identical. As it is seen, the elements 24' to be connected are merely juxtaposed and connected to an angle strip 30, preferably of Perspex, by bolts generally indicated at 31 and essentially similar to those illustrated in FIG. 3.

Figure 5:
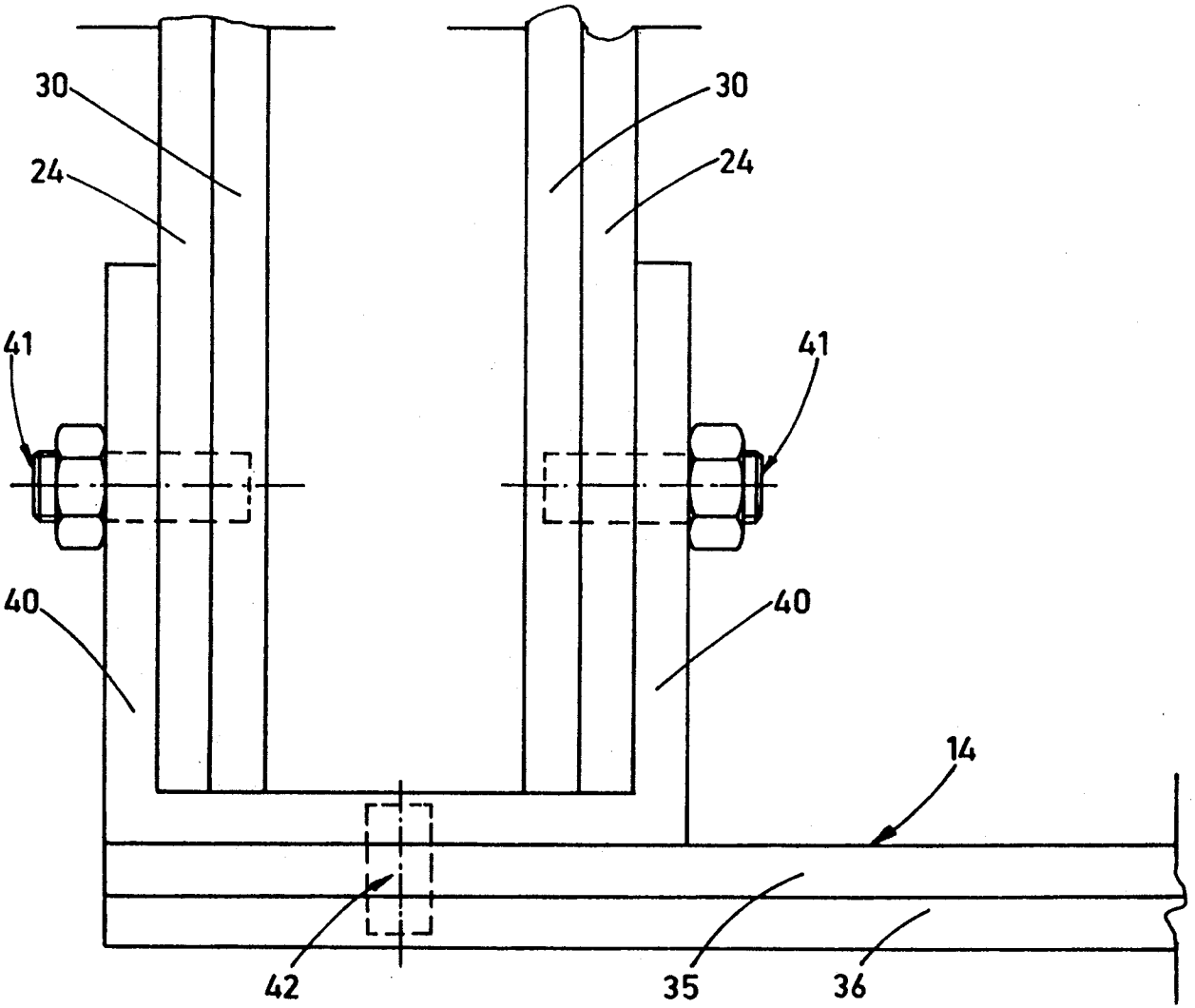
FIG. 5 is a schematic vertical cross-section of FIG. 2, showing the connection of a wall of the room to the floor.

FIG. 5 illustrates the connection between the walls and the floor 14. Said floor may be made of plate 35 only, or can be conveniently made, for purposes of achieving good resistance, of two layers made of plates 35 and 36.

The wall plates 24-24' are connected to the floor 14 by channel elements 40 connected to said wall plates and to the floor by means of bolts 41, similar to the bolts shown in FIG. 3, and sunk screw 42.

Figure 6:
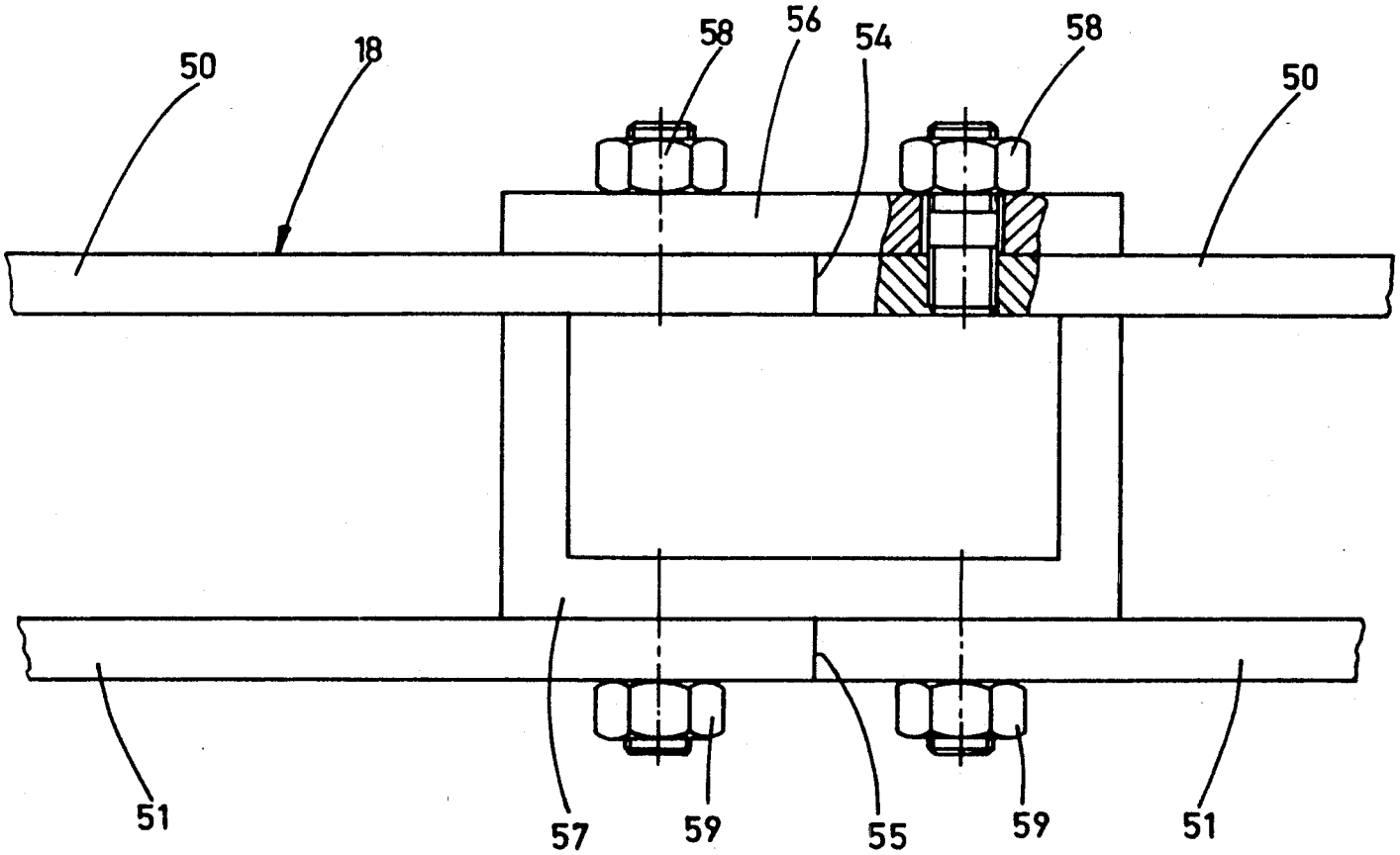
FIG. 6 is a horizontal cross-section showing a detail of the roof.

FIG. 6 illustrates the modular construction of the roof 18. The roof also comprises two layers and consists of outer roof plates 50 and inner roof plates 51. Adjacent plates 50 abut at 54 and adjacent plates 51 abut at 55. Over the abutment 54 is placed a stiffening strip 56. Between the two abutments 54 and 55 is placed a channel 57, also preferably made of Perspex. Channel 57 serves as a distancer between the roof plates 50 and 51, and at the same time serves to interconnect abutting plates 51 and to stiffen the same. Stiffening strips 56 are connected to plates 50 by means of bolts 58, while the distancer channel 57 is connected to plates 51 by bolts 59.

Figure 7:
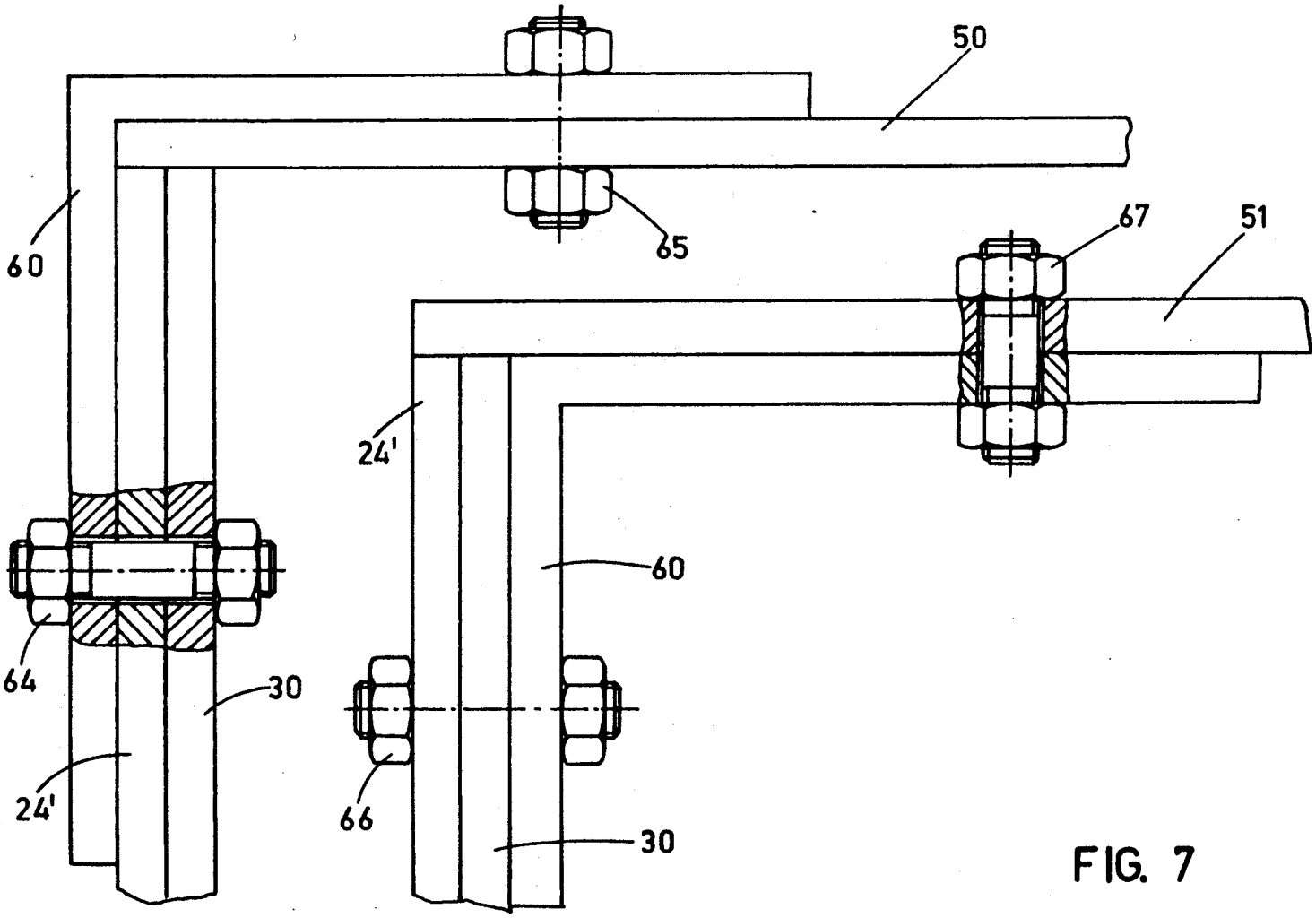
FIG. 7 is a schematic vertical cross-section taken on the same plane as FIG. 5, showing the connection of a wall of the room to the roof.
Figure 8:
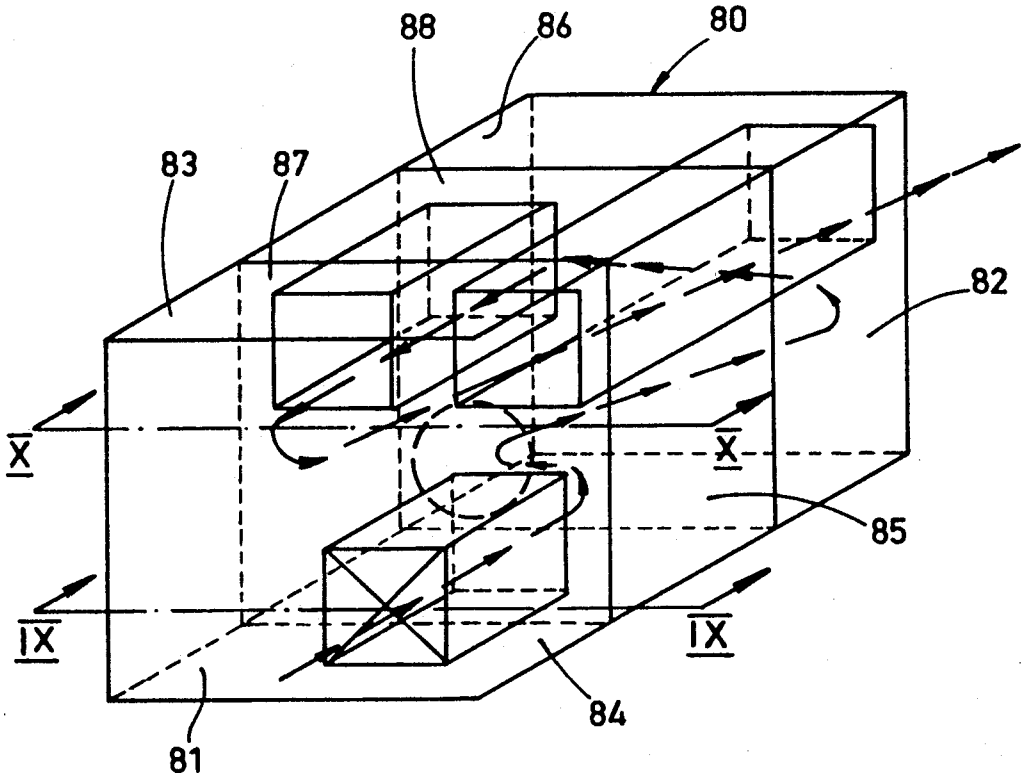
FIG. 8 is a perspective view of an aerating, sound-dampening device according to one preferred embodiment of the invention.

FIG. 7 schematically shows the connection of the roof to the walls. The end plate 50' of the outer layer, which is longer than plates 50, to complete the modular construction of the roof, is connected to plate 24' of the outer wall layer, and the end inner roof plate 51 is connected to plate 24' of the inner wall layer. The two connections are similar, except that the angles 60 which create the connection are place inside and outside respectively of the roof and wall.

In the above drawings, the connections are shown at the angles, in which three elements are seen in cross-section, because the angle element is present. It will be readily understood that cross-sections at other locations (not shown for the sake of brevity) will not show the third, angle, element.

Bolts 64 connect angle elements 60 to angle element 30 and outer wall plates 24' and bolt 65 connects angle elements 60 to roof plate 50, thus connecting the upper roof plates to the outer wall plates. Likewise, bolt 66 connects angle elements 60 to angle elements 30 and inner wall plates 24', and bolt 67 connects angle element 60 to inner roof plates 51, thus connecting the lower roof plates to the inner wall plates. All the bolts shown in the figures described may conveniently be similar to those shown in FIG. 3.

As stated hereinbefore, the eavesdropping-proof room described is preferably provided with aerating devices constructed in a sound dampening configuration. A preferred embodiment thereof will be described, by way of illustration and not limitation, with reference to FIGS. 8 to 14. However, any type of aerating device, having sound dampening properties or not, could be used in carrying out the invention, or they could be dispensed with altogether.

In the drawings, numeral 80 generally indicates the casing of the device which is composed of plate 81, which faces the outside and will be called outer plate, plate 82, which may be mounted in a wall of the closed room to which the device is to be applied, but generally is inside said room, and will be called the inner plate, top plate 83, bottom plate 84 and lateral plates 85 and 86. The device is also provided with inner partitions 87 and 88 which will be called respectively the first and second partition, which divide it into three compartments 90, 91 and 92 (see FIGS. 9 and 10), respectively the outer, the intermediate and the inner compartment. Of course, the number of compartments may be different from three, and suitable partitions will be correspondingly arranged. A person skilled in the art will have no difficulty in extending the teachings of this embodiment to embodiments comprising a greater number of partitions and compartments. Inlet channel 93 (FIG. 9) communicates with the outside, traverses the compartment 90, and ends with an opening at partition 87, whereby it opens into the intermediate compartment 91. Channel 93 may be provided whenever desired with a suction or impelling fan, schematically indicated at 94 in FIG. 9.

Figure 10:
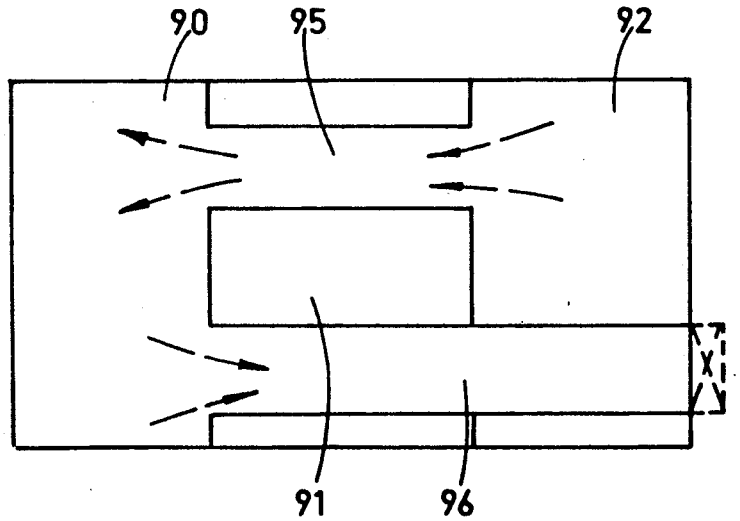
FIG. 10 is a similar horizontal cross-section taken on plane X—X.
Figure 11:
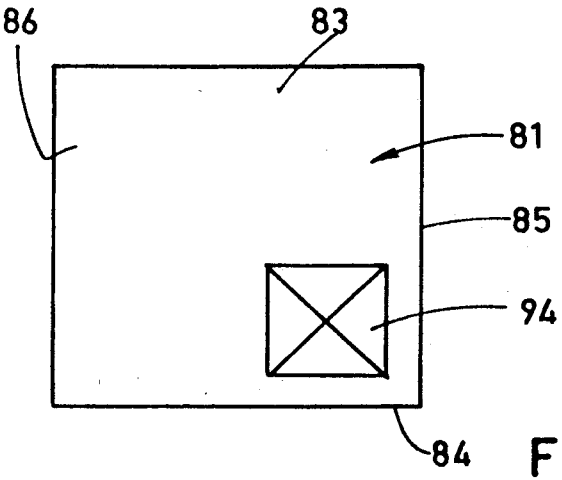
FIGS. 11, 12, 13 and 14 are vertical views of the outer wall, the first and second inner partition, and the inner wall of the device of FIG. 8, respectively, seen from the left of FIGS. 8.
Figure 12:
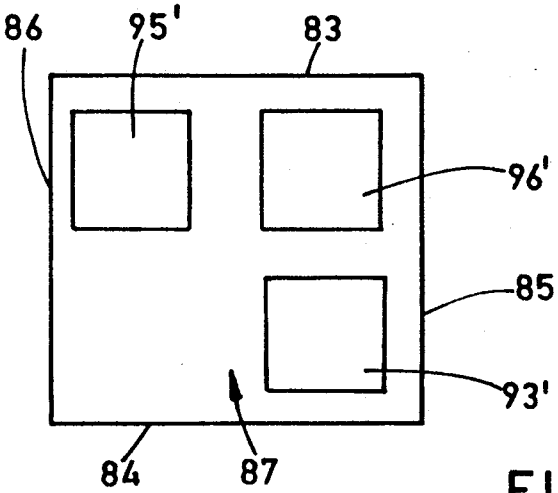
Figure 14:
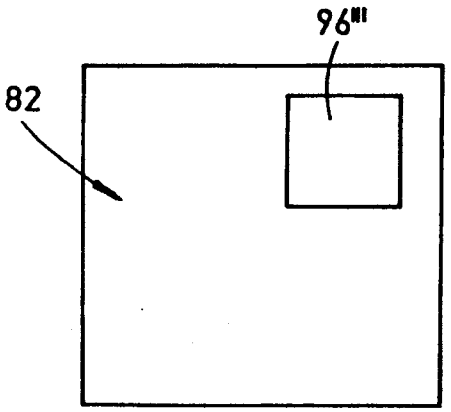
Figure 13:
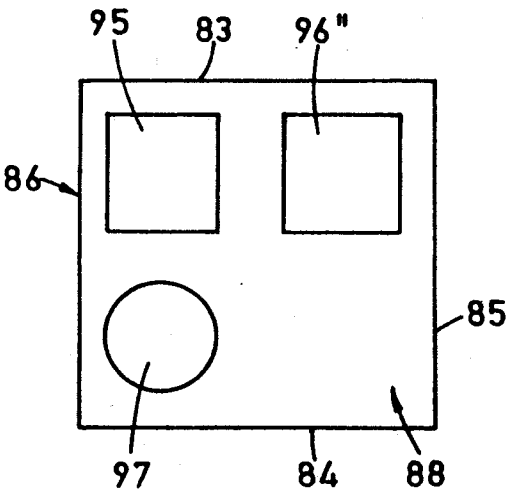

In this embodiment channel 93 is located near the bottom of the device. Near the top of the device are located channels 95 and 96 which, as seen in FIG. 10, traverse respectively intermediate compartment 91 and both intermediate and inner compartments 91 and 92. Opening 97 is provided in partition 88 between the intermediate and the outer compartments. The openings in the outer, inner and intermediate plates of the device are shown in FIGS. 11 to 14, which are self-explanatory. 23', 25', 26', 25'', 26'' and 26''' indicate openings in the wall and partition plates corresponding to channels 23, 25 and 26.

Figure 9:
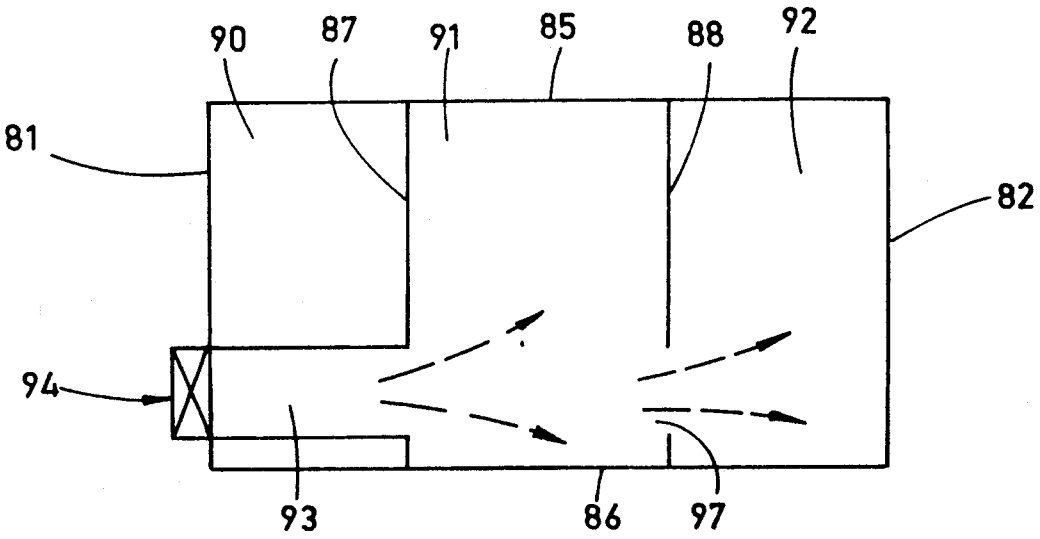
FIG. 9 is a horizontal cross-section thereof taken on plane IX—IX of FIG. 8.

Air entering through channel 93 will expand into the intermediate compartment and in part flow to the inner compartment and expand therein as well, as indicated by the arrows in FIG. 9. From the inner compartment the air will flow into channel 95, and reach the inner compartment and expand therein, as indicated by arrows in FIG. 10. Finally, from the inner compartment 90 the air will enter channel 96 and reach the inside of the room to which the device is applied.

The invention may be carried into practice in different ways, as long as the air introduced into the device is caused to follow a zigzag path through various compartments, flowing through a number of channels from which it expands into the compartments into which the channels open.

The device as hereinbefore described would serve to introduce air into a closed room. If it were desired to draw air from a closed room, the same device could be employed by reversing it, in such a way that plate 81 and fan 94 will be flush with a wall of the room or be placed inside the room. In that case, fan 94 will be a suction fan. Likewise, the deice could be reversed by applying a fan 94' to the outlet of channel 96, as shown in broken lines in FIG. 10.

It will be understood that the device can be mounted in any convenient relationship with the walls of the room to which it is to provide aeration. Thus, the wall of the room, in which the device will be supported, may be flush with plate 82 or with plate 81 or be at any intermediate position between the two plates, so that the device will be entirely outside or entirely inside or partly outside and partly inside the room.

The device will preferably be made of transparent material, e.g., Perspex. To prevent unauthorized persons from looking inside the room from the outside, convenient surfaces of the device may be rendered opaque or specular. For instance, if plates 81 and 82 are flush with a wall of the room, one surface thereof may be rendered opaque or may be provided with an opening or reflecting coating. If the device is partly outside and partly inside the room, it may be necessary to provide it with a coating apart of the top and bottom.

As discussed above, the preferred eavesdropping-proof room has a floor, a roof element, a door, and wall elements wherein listening devices are easily located. A plurality of boundary components having an inner layer and an outer layer are connected by distancer elements defining a cavity therebetween. The inner layers of the plurality of boundary components are connected by inner angle elements. The outer layers of the plurality of boundary components are connected by outer angle elements to form a self-supporting eavesdropping proof room having an inner and outer layer. The inner and outer angle elements defining a cavity therebetween. The boundary components are configured as standardized components permitting modular construction with adjoining boundary components. The inner and outer layers, and angle elements are substantially transparent so that any device that may be located in either cavity for transmitting or registering conversations that take place within the room will be visible.

The configuration of the zigzag path of the air may be varied at will, as long as the path is considerably longer than the length of the device and involves returning the air at least once to a compartment which it has already traversed and expanding the air at least once from a channel to a compartment of greater cross-section.

As said, alternative sound-dampening aerating devices can be employed. For instance, a "compartment" device is known in the art, in which air is transported batchwise, by rotating a device provided with separated sections, each of which contains "a batch" of air which is charged in the room and discharged to the outside when the section reaches an outer opening.

An embodiment of an eavesdropping-proof room according to the invention has been described, by way of exemplification, but it will be understood that numberous variations, modifications and adaptations can be made therein by a person skilled in the art without departing from the invention or exceeding the scope of the appended claims.

As has been noted hereinbefore, the means for preventing eavesdropping on a conversation, according to the invention, may comprise, in combination with an eavesdropping-proof room, means for producing or generating noise around the room or in the cavities that exist in the boundary elements thereof. Preferably a white noise is generated by means of suitable generators. These need not be described, since they are well known to persons skilled in the art. Said generators may be positioned in any appropriate position and in any appropriate number, and will preferably be so positioned in the space surrounding the eavesdropping-proof room. Alternatively, if desired, they may be positioned to generate white noise in the cavities of the walls of the eavesdropping-proof room. In the embodiment of the eavesdropping-proof room described, cavities exist in the walls and in the roof, which are of a two-layer construction, but not in the floor. However, the floor could easily be constructed so as to comprise two layers and be therefore provided with cavities as well, in correspondence of which, if desired, white noise generating devices could be installed.

Likewise, appropriate lighting devices can be positioned around and within the room, to provide the desired light effect, to prevent the view of what takes place in the room.

The invention, in all its aspects, could be carried out of course with any variations, adaptations and modifications that can be devised by persons skilled in the art.

I claim:

1. Eavesdropping-proof room having a floor, a roof element, a door, and wall elements wherein listening devices are easily located, comprising:

a plurality of boundary components having an inner layer and an outer layer connected by distancer elements defining a cavity therebetween, the inner layers of said plurality of boundary components connected by inner angle elements and the outer layers of said plurality of boundary components connected by outer angle elements to form a self-supporting eavesdropping proof room having an inner and outer layer, inner and outer angle elements defining a cavity therebetween, the boundary components being configured as standardized components permitting modular construction with adjoining boundary components, the inner and outer layers, and angle elements being substantially transparent so that any device that may be located between the inner and outer layers or inner and outer angle elements for transmitting or registering conversations that take place within the room will be visible.

2. The apparatus of claim 1 wherein the outer layer is rendered opaque to conceal what occurs within the room.

3. The apparatus of claim 2 wherein the outer layer is rendered opaque by the addition of a reflective layer.

4. The apparatus of claim 1 wherein the floor, roof element, and wall elements are connected to one another by rigid angle strips.

5. The apparatus of claim 1 wherein the inner and outer layers are constructed of semi-flexible sheets or plates made generally rigid by stiffening elements.

6. The apparatus of claim 5 wherein the semiflexible sheets or plates are constructed of polycarbonate and the stiffening elements are constructed of a transparent rigid plastic.

7. The apparatus of claim 5 wherein at least two adjacent and abutting sheets are interconnected by joint elements which overlap the abutments of the sheets so that the boundary components may be modularly connected.

8. The apparatus of claim 1 further comprising aerating means for aerating the inside of the room.

9. The apparatus of claim 8 wherein the aerating means is also a sound-dampening means for preventing acoustic transmission of sound through the boundary components.

10. The apparatus of claim 9 wherein the sound-dampening means includes noise generating means for generating noise in the cavities of the boundary components.

11. The apparatus of claim 10 wherein the noise is white noise.

* * * * *

UNITED STATES PATENT AND TRADEMARK OFFICE

CERTIFICATE OF CORRECTION

PATENT NO. : 5,239,792

DATED : 31 August 1993

INVENTOR(S) : Avni

It is certified that error appears in the above-identified patent and that said Letters Patent is hereby corrected as shown below:

In column 3, line 61, after the word "invention", insert --in--.

In column 4, line 44, delete "8" and insert --9 and 10--.

In column 7, line 32, delete "deice" and insert --device--.

In column 7, line 47, delete "and" and insert --or--.

In column 10, claim 7, line 5, delete "elements which overlap" and insert --means for overlapping--.

In column 10, claim 8, line 9, after the word "room", insert --through at least one of said boundary components to the area outside the eavesdropping-proof room.--

Signed and Sealed this

Seventh Day of June, 1994

*Attest:*

Bruce Lehman

BRUCE LEHMAN

*Attesting Officer*

*Commissioner of Patents and Trademarks*